US008696106B1

(12) United States Patent
Moorlag et al.

(10) Patent No.: US 8,696,106 B1
(45) Date of Patent: Apr. 15, 2014

(54) THERMALLY SWITCHABLE TRANSFIX BLANKET MADE WITH GRAFTED SWITCHABLE POLYMER FOR INDIRECT PRINTING METHODS

(71) Applicant: Xerox Corporation, Norwalk, CT (US)

(72) Inventors: Carolyn P. Moorlag, Mississauga (CA); Gabriel Iftime, Mississauga (CA); Sarah J. Vella, Milton (CA); Barkev Keoshkerian, Thornhill (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/746,920

(22) Filed: Jan. 22, 2013

(51) Int. Cl.
*B41J 2/01* (2006.01)
*G03G 15/16* (2006.01)

(52) U.S. Cl.
CPC ..... *G03G 15/161* (2013.01)
USPC ..... 347/103; 347/105

(58) Field of Classification Search
CPC .... G03G 15/161; G03G 15/162; B41J 2/0057
USPC ..... 347/101, 103, 105
See application file for complete search history.

(56) References Cited

U.S. PATENT DOCUMENTS

| | | | | |
|---|---|---|---|---|
| 5,389,958 | A | 2/1995 | Bui et al. | |
| 8,187,711 | B2 * | 5/2012 | Wu et al. | 428/412 |
| 8,293,369 | B2 * | 10/2012 | Wu et al. | 428/421 |
| 8,349,463 | B2 * | 1/2013 | Wu et al. | 428/473.5 |
| 8,377,523 | B2 * | 2/2013 | Wu | 428/32.69 |
| 2010/0251914 | A1 | 10/2010 | Zhou et al. | |
| 2010/0330305 | A1 | 12/2010 | Wu | |
| 2011/0104499 | A1 | 5/2011 | Wu et al. | |
| 2011/0244202 | A1 | 10/2011 | Wu et al. | |
| 2011/0244247 | A1 | 10/2011 | Wu et al. | |
| 2012/0049121 | A1 | 3/2012 | Wu | |

OTHER PUBLICATIONS

Mori et al., "Temperature Induced Changes in the Surface Wettability of SBR+PNIPA Film," 292 Macromol. Mater. Eng., vol. 917, pp. 917-922, 2007.

Galaev et al., "Thermoreactive water-soluble polymers, nonionic surfactants, and hydrogels as reagents in biotechnology," Enzyme Microb. Technol., May 1993, pp. 354-366, vol. 15, Butterworth-Heinemann.

U.S. Appl. No. 13/746,910, filed Jan. 22, 2013 to Moorlag et al.

* cited by examiner

*Primary Examiner* — Huan Tran
(74) *Attorney, Agent, or Firm* — Oliff PLC

(57) ABSTRACT

A polymer composition includes a first polymer layer containing a base polymer matrix, and a second polymer layer grafted onto the first layer. The second polymer layer contains a stimulus-responsive polymer, and the surface free energy of the stimulus-responsive polymer is adjustable from a first surface free energy state to a second surface free energy state when heated to a critical activation temperature. A method of preparing a polymer composition includes providing a first polymer layer containing a base polymer, and grafting a second polymer layer containing a stimulus-responsive layer onto the first layer. A method of printing an image involves applying an ink onto an intermediate transfer member containing a first polymer layer containing a base polymer matrix and a second polymer layer containing a stimulus-responsive polymer grafted onto the first layer, spreading the ink, inducing a property change of the ink, and transferring the ink to a substrate.

20 Claims, 2 Drawing Sheets

THERMALLY SWITCHABLE TRANSFIX BLANKET MADE WITH GRAFTED SWITCHABLE POLYMER FOR INDIRECT PRINTING METHODS

TECHNICAL FIELD

The present disclosure is generally related to indirect printing methods, and more specifically, to intermediate transfer members and processes involving intermediate transfer members.

RELATED APPLICATIONS

U.S. patent application Ser. No. 13/746,910, entitled "Thermally Switchable Transfix Blanket Made of Blend Polymers for Aqueous Inkjet," which is being concurrently filed herewith, describes a polymer composition comprising a stimulus-responsive polymer dispersed in a base polymer matrix, where the surface free energy of the polymer composition is reversibly adjustable from a first surface free energy state to a second surface free energy state when the polymer composition is heated to a predetermined critical activation temperature.

U.S. Patent Application Publication No. 2010/0251914 to Zhou et al. describes an imaging member comprising a substrate and a surface layer comprising a heat sensitive material permitting reversible switching between compatible and non-compatible states within one second.

The entire disclosures of the above-mentioned applications are totally incorporated herein by reference.

BACKGROUND

Indirect printing methods generally include a two-step printing process involving first applying ink imagewise onto an intermediate transfer member (such as a drum or a belt) using an inkjet printhead to form a transient image, and then transferring the transient image to a substrate. When the ink is applied onto the intermediate transfer member (also called, for example, an intermediate receiving member, a blanket, or a transfix blanket), it wets or spreads to form a transient image. The transient image then undergoes a change in properties (such as partial or complete drying, thermal or photo-curing, gelation, and so forth), and is transferred to the substrate. An exemplary offset or indirect printing process is disclosed in U.S. Pat. No. 5,389,958, the disclosure of which is incorporated herein by reference.

Intermediate transfer members suitable for use in indirect printing desirably exhibit surface properties (such as energy, topology, and so forth) that meet the sub-system requirements of the inkjet/transfix printing architecture, including wetting of the ink and subsequently (such as after phase change or the like) transferring the transient image (that is, the residual ink film along with pigment) onto a substrate. Several classes of materials may be used to form intermediate transfer members, including silicone, fluorosilicone, and Viton. However, these are hydrophobic materials, and the inherent low surface tension of these materials precludes wetting of aqueous ink drops. A higher surface tension material may be used to form the intermediate transfer member, but the high surface tension of such materials would impede efficient transfer of the image from the intermediate transfer member.

Because the surface free energy requirements of the intermediate transfer member desirable for wetting the ink are different than those for transferring the transient image, intermediate transfer members that display good wettability do not efficiently transfer the ink film onto a substrate, and conversely, intermediate transfer members that efficiently transfer the image to the substrate do not wet the ink. Thus, to date, intermediate transfer members have not enabled both functions (that is, both wetting and transfer).

In view of the above, there is a continuous need for improving intermediate transfer members used in indirect printing methods.

SUMMARY

The present disclosure provides a polymer composition including a first polymer layer containing a base polymer matrix, and a second polymer layer grafted onto the first polymer layer, where the second polymer layer contains a stimulus-responsive polymer. In embodiments, the surface free energy of the stimulus-responsive polymer is reversibly adjustable from a first surface free energy state to a second surface free energy state when heated to a predetermined critical activation temperature.

The present disclosure also provides a method of preparing a polymer composition, involving providing a first polymer layer containing a base polymer matrix, and grafting a second polymer layer containing a stimulus-responsive polymer onto the first polymer layer. In embodiments, the surface free energy of the stimulus-responsive polymer may be reversibly adjusted from a first surface free energy state to a second surface free energy state when heated to a predetermined critical activation temperature.

The present disclosure further provides a method of printing an image to a substrate, involving applying an inkjet ink onto an intermediate transfer member using an inkjet printhead, spreading the ink onto the intermediate transfer member, inducing a property change of the ink, and transferring the ink to a substrate. In embodiments, the intermediate transfer member contains a first polymer layer containing a base polymer matrix and a second polymer layer containing a stimulus-responsive polymer, where the second polymer layer is grafted onto the first polymer layer. In embodiments, the surface free energy of the stimulus-responsive polymer is reversibly adjustable from a first surface free energy state to a second surface free energy state when heated to a predetermined critical activation temperature.

EMBODIMENTS

Figure 1:
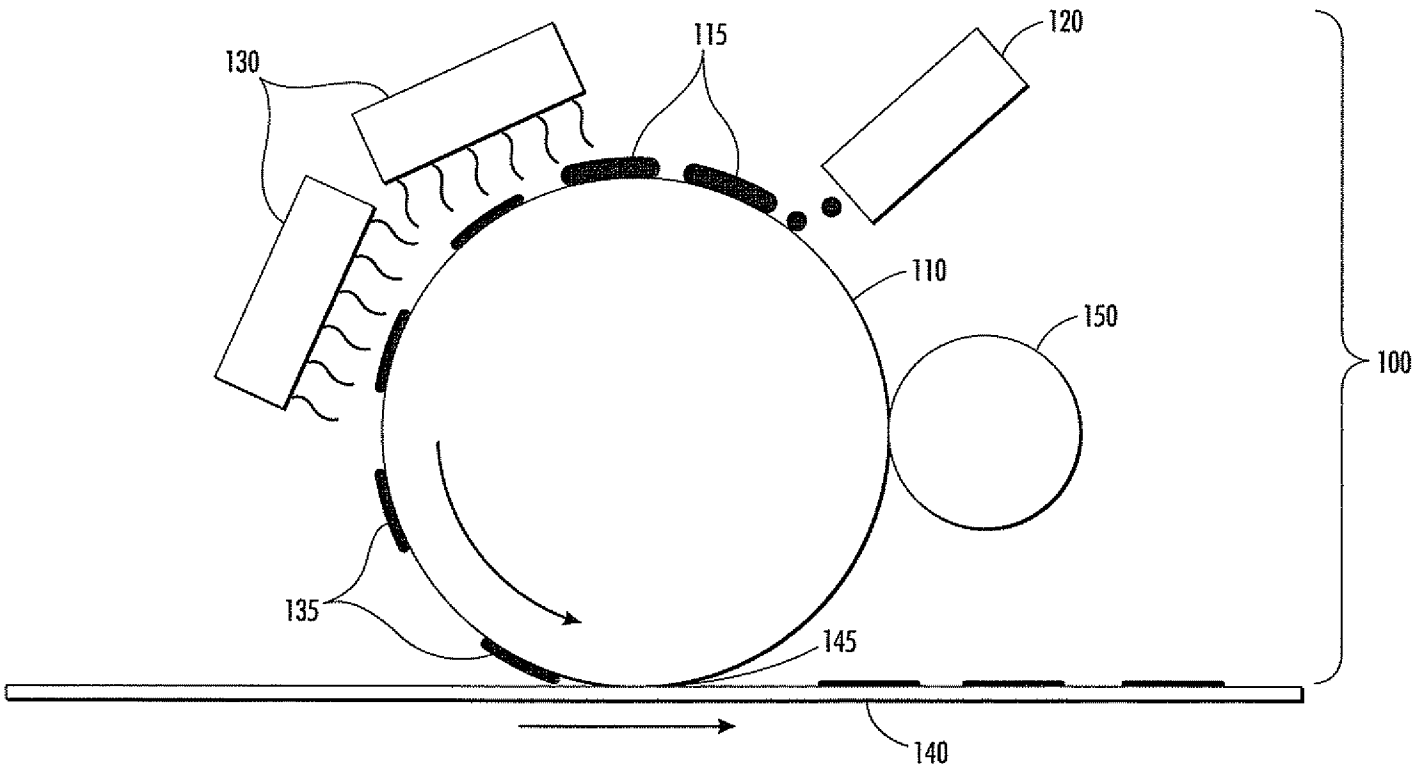
FIG. 1 is a schematic representation of a two-step printing process.

The present disclosure provides a polymer composition comprising a first polymer layer comprising a base polymer matrix, and a second polymer layer comprising a stimulus-responsive polymer, where the second polymer layer may be grafted onto the first polymer layer. In embodiments, the surface free energy of the stimulus-responsive polymer may be reversibly adjusted from a first surface free energy state to a second surface free energy state when heated to a predetermined critical activation temperature.

Intermediate transfer members incorporating such polymer compositions may switch their surface free energy in response to a stimulus (such as being heated to a critical activation temperature) and, thus, the surface free energy of the intermediate transfer members may be adjusted, for example, to enable both wetting and transfer. Such intermediate transfer members may therefore exhibit good wettability while also being able to efficiently transfer the transient image to the substrate. Because such intermediate transfer members may improve both ink spreading and ink transfer—as opposed to optimizing one at the expense of the other—they consequently yield an improved image quality.

Because the second polymer layer containing a stimulus-responsive polymer may be grafted on the first polymer layer, the stimulus-responsive polymer may be positioned on a surface of the polymer composition. Accordingly, the stimulus-responsive polymer layer may be located on a surface of an intermediate transfer member, which improves the response of the intermediate transfer member to a stimulus—that is to say, because the stimulus-responsive layer may be located on the surface of the intermediate transfer member, the degree of change between the first surface free energy state and the second free energy state (i.e., the absolute difference between surface free energy states) may be greater. Grafting of the active stimulus-responsive polymer onto the surface means that the responsive polymer is chemically bonded onto the surface, instead of coated as a layer onto the first polymer layer. Chemical bonding enhances the robustness of the final switchable transfix blanket.

As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

The terms "hydrocarbon" and "alkane" refer, for example, to branched and unbranched molecules having the general formula $C_nH_{2n+2}$, in which n is a number of 1 or more, such as from about 1 to about 60. Exemplary alkanes include methane, ethane, n-propane, isopropane, n-butane, isobutene, tort-butane, octane, decane, tetradecane, hexadecane, eicosane, tetracosane, and the like. Alkanes may be substituted by replacing hydrogen atoms with one or more functional groups to form alkane derivative compounds.

The term "functional group" refers, for example, to a group of atoms arranged in a way that determines the chemical properties of the group and the molecule to which it is attached. Examples of functional groups include halogen atoms, hydroxyl groups, carboxylic acid groups, and the like.

The term "alkyl group" refers, for example, to hydrocarbon groups that are linear or branched, saturated or unsaturated, and cyclic or acyclic, and with from about 1 to about 50 carbon atoms, such as from about 5 to about 35 carbon atoms, or from about 6 to about 28 carbon atoms.

The term "oleophobic" refers, for example, to a physical property of a molecule relating to having a lack of a strong affinity for oils. Water and fluorocarbons can be examples of oleophobic compounds. The term "oleophilic" refers, for example, to a physical property of a molecule relating to having an affinity for oils.

Indirect Printing

FIG. 1 shows one embodiment of a printing apparatus according to the present disclosure. The printing apparatus 100 comprises an intermediate transfer member 110. In the illustrated embodiment, the intermediate transfer member is a cylinder (such as a drum); however, the intermediate transfer member may be in alternate forms. More specifically, the intermediate transfer member may be in the form of an endless flexible belt, a web, a flexible drum or roller, a rigid roller or cylinder, a sheet, a drelt (a cross between a drum and a belt), a seamless belt, that is with an absence of any seams or visible joints in the members, and the like.

In the depicted embodiment, the intermediate transfer member 110 rotates counterclockwise. The apparatus includes an inkjet printhead 120, which applies ink imagewise onto the intermediate transfer member 110. The ink wets and spreads on the intermediate transfer member 110 to form the transient image 115. The transient image 115 then undergoes a change in properties (such as partial or complete drying, thermal or photo-curing, gelation, and so forth). The change in properties may be induced, for example, by a property change device 130.

After the image undergoes a change in properties, the resulting post-phase-change transient image 135 may be transferred to a recording medium or printing substrate 140. The intermediate transfer member 110 may undergo a change in properties to further enable transfer. For example, because the surface free energy desirable for transfer is lower than the surface free energy desirable for wetting, the surface free energy of the intermediate transfer member 110 may be switched to a surface free energy state that enables wetting, and then switched to a surface free energy state to enable transfer of the transient image to the substrate. In the depicted embodiment, the recording medium or printing substrate 140, such as paper, may be fed to a nip region 145 in the direction of the arrow. The ink image may then be transferred from the intermediate transfer member 110 to the printing substrate 140. A cleaning unit 150 may clean the intermediate transfer member 110 of any residual ink, dust, or other materials after transfer of the ink images has been completed.

In embodiments, an indirect printing process according to the instant disclosure may use an intermediate transfer member including a polymer composition containing a first polymer layer containing a base polymer matrix, and a second polymer layer grafted onto the first polymer layer, where the second polymer layer may contain a stimulus-responsive polymer. In embodiments, the surface free energy of the intermediate transfer member may be adjusted by exposing the intermediate transfer member to a stimulus. For example, in embodiments, the surface free energy of the polymer composition (and the intermediate transfer member containing such a polymer composition) may be reversibly adjusted from a first surface free energy state to a second surface free energy state by heating the polymer composition to a predetermined critical activation temperature.

For example, in embodiments, the polymer composition may reversibly switch from a relatively higher first surface free energy state to a relatively lower second surface free energy state when heated to a temperature at or greater than a predetermined activation temperature. When the temperature of the polymer composition is less than the predetermined critical activation temperature, the polymer composition may switch to the relatively higher surface free energy state. Thus, in embodiments, the surface free energy of the polymer composition may be switched reversibly and controllably when heated between two states: a higher surface free energy state and a lower surface free energy state. In embodiments, the lower surface free energy state may enable the transfer step while the higher surface free energy state may enable the spreading (wetting) step. A surface free energy state that enables the spreading (wetting) step may have a surface free energy that is greater than the surface tension of the liquid ink, while a surface free energy state that enables transfer may have a surface free energy that is lower than the surface free energy of the dry (resin) ink.

In embodiments, the surface free energy of the stimulus-responsive polymer in the first surface free energy state may be from about 26 to about 70 dynes/cm, such as from about 30 to about 60 dynes/cm, or from about 35 to about 55 dynes/cm. The second surface free energy state may be, for example, from about 3 to about 25 dynes/cm, such as from about 10 to about 23 dynes/cm, or from about 15 to about 20 dynes/cm. In embodiments, the difference between the second surface free energy state and the first surface free energy state may be greater than about 1, such as greater than about 10, or greater than about 20, such as a difference of from about 1 to about 67 dynes/cm, or from about 10 to about 60 dynes/cm, or from about 20 to about 50 dynes/cm.

In embodiments, ink may be jetted onto the intermediate transfer member when the intermediate transfer member is in a surface free energy state that enables wetting of the ink. Heat or other stimulus may then be applied to the intermediate transfer member to increase the temperature of the intermediate transfer member above the critical activation temperature, thereby switching the surface free energy to a state that will increase the efficiency of the transfer of ink from the intermediate transfer member to a substrate.

Any suitable temperature source may be used to cause the temperature change in the intermediate transfer member. Exemplary heat sources include a heat lamp, an optical heating device such as a laser or an LED bar including IR light LED bar, a thermal print head, resistive heating fingers, or a microheater array. A resistive heating finger is an array of finger-like micro-electrodes that result in resistive heating when the fingers are in contact with the surface that is to be heated. In embodiments, the heat used to switch the intermediate transfer member to its release state (i.e., lower surface energy) is provided at the time of the phase change process during the process, by the property change device 130. In embodiments, the blanket may cool on its own by contact with the colder paper substrate and after the removal of heat. Optionally, an air jet may be used to accelerate cooling. This is particularly suitable for printing at very high speeds.

Intermediate Transfer Member

An intermediate transfer member suitable for the above-two step printing process desirably has surface properties (such as energy, topology, and so forth) both to enable wetting of the ink and to enable complete transfer of the transient image (residual ink film along with pigment) onto a substrate. For the ink to wet well (i.e., spread) onto the intermediate transfer member, the surface free energy of the intermediate transfer member is desirably higher than the surface tension of the liquid ink. For the ink to subsequently be transferred from the intermediate transfer member to the substrate, the surface free energy of the intermediate transfer member is desirably lower than the surface free energy of the dry (resin) ink. Thus, the surface free energy of the intermediate transfer member desirable for wetting the ink may be different from the surface free energy desirable for transferring the ink image to the substrate.

As a general matter, the wettability or spread of a liquid on a surface is governed by the forces of interaction between the liquid, the surface, and the surrounding air, and in particular the surface free energy, as relating to the surface chemistry and surface topology. Surface tension is a parameter that can be described as the interaction between the forces of cohesion and the forces of adhesion, which determines whether or not wetting, or the spreading of liquid across a surface, occurs.

Young's Equation, which defines the balance of forces caused by a wet drop on a dry surface, stipulates that:

$$\gamma_{SL}+\gamma_{LV}\cos\theta=\gamma_{SV}$$

where $\gamma_{SL}$=forces of interaction between a solid and liquid; $\gamma_{LV}$=forces of interaction between a liquid and surrounding air; $\gamma_{SV}$=forces of interaction between a solid and surrounding air; and $\theta$=contact angle of the drop of liquid in relation to the surface. Young's Equation also shows that, if the surface tension of the liquid is lower than the surface energy, the contact angle is zero and the liquid wets the surface. The surface energy depends on several factors, such as the chemical composition and crystallographic structure of the solid, and in particular of its surface, the geometric characteristics of the surface and its roughness, and the presence of molecules physically adsorbed or chemically bonded to the solid surface.

According to the instant disclosure, the surface free energy of the intermediate transfer member may be switched from a first surface free energy state to a second surface free energy state in response to a stimulus. For example, in embodiments, the surface free energy of the intermediate transfer member may be reversibly switched from a relatively higher surface free energy state to a relatively lower surface free energy state when heated to a predetermined critical activation temperature. However, the direction in which the stimulus-responsive polymer switches when heat is applied may vary. In some embodiments, the surface free energy of the stimulus-responsive polymer may increase when the stimulus-responsive polymer is heated above the critical activation temperature. In other embodiments, the surface free energy of the stimulus-responsive polymer may decrease when the stimulus-responsive polymer is heated above the critical activation temperature. Accordingly, in embodiments, the polymeric composition according to the instant disclosure may be hydrophilic at temperatures below the critical activation temperature, and hydrophobic at elevated temperatures. In other embodiments, the polymeric composition may be oleophilic at temperatures below the critical activation temperature and oleophobic at elevated temperatures.

In embodiments, an intermediate transfer member according to the instant disclosure may include a polymer composition containing a first polymer layer containing a base polymer matrix, and a second polymer layer grafted onto the first polymer layer. In embodiments, the second polymer layer may comprise a stimulus-responsive polymer. The surface free energy of the stimulus-responsive polymer may be reversibly adjustable from a first surface free energy state to a second surface free energy state when heated to a predetermined critical activation temperature.

In embodiments, the stimulus-responsive polymer may be responsive to a thermal stimulus. In embodiments, the stimulus-responsive polymer may be considered as switching states (i.e., between a relatively higher surface free energy and a relatively lower surface free energy) when heated to a temperature change of from about 10° C. to about 80° C., such as from about 10° C. to about 50° C., or from about 10° C. to about 20° C. (that is, a relative temperature difference). In embodiments, the stimulus-responsive polymer may switch states when heated to a temperature greater than about 10° C. and less than about 120° C., such as from about 25° C. to about 90° C., or from about 30° C. to about 60° C.

In embodiments, the stimulus-responsive polymer may comprise a poly-(N-alkylacrylamide) polymer. The poly-(N-alkylacrylamide) polymer may be, for example, a homopolymer or a copolymer comprising an acrylamide monomer. The poly-(N-alkylacrylamide) polymer may contain an N-alkylacrylamide unit of Formula (I):

Formula (I)

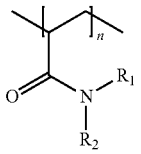

where the $R_1$ and $R_2$ groups may be the same or different and are hydrogen or alkyl having from 1 to about 10 carbon atoms, such as from about 1 to about 6 carbon atoms, or cycloalkyl with a number of carbons from about 3 to about 10, or may be a heterocycle incorporating the N atom with a number of carbons from 3 to 5. However, not any combination of R groups may provide a thermally switchable polymer. Specific examples of suitable groups are shown in the Table 1, from Galaev, I. Y. and B. Mattiasson, 15(5) *Enzyme and Microbial Technology* 354 (1993), the disclosure of which is incorporated by reference herein in its entirety.

TABLE 1

Chemical structures, names and transition temperatures of suitable thermally responsive poly(N-substituted acrylamides) in water.

| $—NR_1R_2$ | Poly (N-alkylacrylamide) | Switching temperature [LCST] (° C). |
|---|---|---|
| NH—$CH_2$—$CH_3$ | Poly(N-ethylacrylamide | 82 |
| NH—$CH_2$—$CH_2$—$CH_3$ | Poly(N-n-propylacrylamide) | 22 |
| NH—CH—$(CH_3)_2$ | Poly(N-isopropylacrylamide) | 32-34 |
| $N(CH_3)(CH_2—CH_3)$ | Poly(N-ethyl,N-methylacrylamide) | 56 |
| N $(CH_2—CH_3)_2$ | Poly(N,N-diethylacrylamide) | 32-42 |
| $N(CH_2—(CH_3)_2)(CH_3)$ | Poly(N-isopropyl,N-methylacrylamide) | 25 |
| 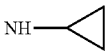 | Poly(N-cyclopropylacrylamide) | 47 |
| 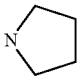 | Poly(N-acryloylpyrrolidine) | 55 |
| 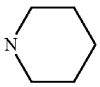 | Poly(N-acryloylpiperidine) | 4 |

All other combinations of alkyl groups with up to about 6 carbon atoms may not be thermally responsive. Some combinations with very small alkyl groups are fully soluble in water, such as polymers where the $NR_1R_2$ group is $NH_2$, $NHCH_3$, and $N(CH_3)_2$. Others are totally insoluble in water because the R groups render them too non-polar and do not allow the chain reconfiguration for thermal switching. Such examples include those where the $NR_1R_2$ group is $NH(CH_2CH_2CH_2CH_3)$, $NHC(CH_3)_3$, $N(CH_2CH_3)(CH_2CH_2CH_3)$, and $N(CH_2CH_2CH_3)_2$.

The switching temperature of the thermo-responsive polymer may be generally affected by the solvent and binder or polymer matrix in general. The values reported in Table 1 are for solutions in water. It has been shown previously that the presence of organic binder increases the switching temperature for a given thermally switchable material. For example, poly-(N-isopropylacrylamine) switches at 32° C. in water, but at 41° C. in mixture with an organic polymer such as SBR rubber. When dissolved in an organic solvent such as THF, the switching temperature shifted to 60° C. See N. Mori et al., *Temperature Induced Changes in the Surface Wettability of SBR+PNIPA Films,* 292 Macromol. Mater. Eng. 917, 917-22 (2007).

In embodiments, one or more than one of the above poly-(N-alkyl-acrylamide) may be grafted onto the surface of the first layer. This may be advantageous for fine-tuning the switching temperature of the final thermally responsive layer.

In embodiments, $R_1$ may be isopropyl and $R_2$ may be H, so that the acrylamide polymer is poly(N-isopropylacrylamide) (PNIPA) (i.e., the homopolymer) or an N-isopropylacrylamide copolymer. When the acrylamide polymer is an N-isopropylacrylamide (NIPAM) copolymer, the acrylamide monomer may comprise from about 30 to about 100% of the repeating units of the copolymer, or from about 30 to about 100 mole percent of the copolymer. The other comonomer of the copolymer may be, for example, styrene, bisphenol-A, acrylic acid, 4-vinylphenylboronic acid (VPBA), ethylmethacrylate; methylmethacrylate (MMA), butylmethacrylate (BMA), N,N-diethylaminoethyl methacrylate (DEAEMA), or methacrylic acid (MAA). The other comonomer could also be a fluorinated alkyl acrylate or fluorinated alkyl methacrylate, such as hexafluoroisopropylmethacrylate (HFIPMA) or 2,2,3,3,4,4-hexafluorobutylmethacrylate (HFBMA). The other comonomer could also be another acrylamide monomer, such as N-ethylacrylamide (NEAM), N-methylacrylamide (NMAM), N-n-propylacrylamide (NNPAM), N-t-butylacrylamide (NtBA), or N,N-dimethylacrylamide (DMAM).

In embodiments, the stimulus-responsive polymer may be PNIPA, having the following Formula (II):

Formula (II)

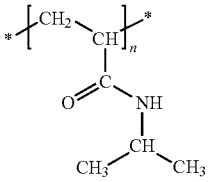

PNIPA where n may be an integer of from about 3 to about 1000, such as from about 5 to about 500, or from about 10 to about 300. PNIPA is a heat sensitive material that exhibits a large change in surface energy in response to a small change in temperature. See, for example, N. Mori et al., *Temperature Induced Changes in the Surface Wettability of SBR+PNIPA Films,* 292 Macromol. Mater. Eng. 917, 917-22 (2007), the entire disclosure of which is incorporated herein in its entirety. PNIPA has a hydrophobic isopropyl group on a side chain. It is soluble in water below 32° C. and becomes insoluble when heated above this critical temperature. This switching temperature (32° C.) between hydrophilic and hydrophobic states is called the lowest critical solution temperature (LCST). The contact angle of a water drop placed onto a PNIPA polymer film may change dramatically above and below the LCST—in one experiment, the contact angle of a water drop placed onto the PNIPA film changed from about 60° (hydrophilic) below 32° C. to over 93° (hydrophobic) when heated above 32° C.

Figure 2:
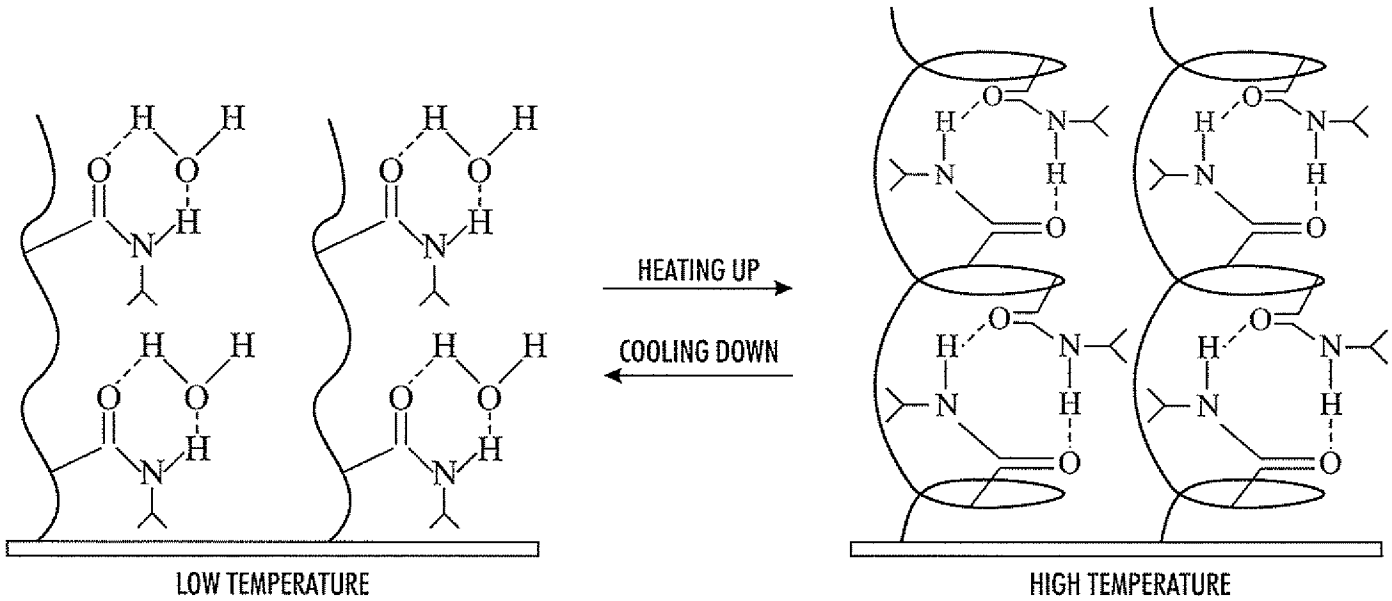
FIG. 2 is a diagram illustrating the difference in hydrogen bonding of a poly(n-isopropylacrylamide) polymer above and below a lower critical solution temperature (LCST).

Without being bound by any particular theory, it is believed that at a temperature below LCST, the PNIPA chains form expanded structures caused by intermolecular hydrogen bonding occurring predominantly between the PNIPA chains and the water molecules present in the applied solution. This intermolecular bonding contributes to the hydrophilicity of the PNIPA-modified surface. However, at temperatures above the LCST, hydrogen bonding occurs predominantly between the PNIPA chains themselves, with the carbonyl oxygen atom of one PNIPA chain bonding to the hydrogen atom on the nitrogen tom of the adjacent PNIPA chain. This intermolecular hydrogen bonding between the C═O and N—H groups of adjacent PNIPA chains results in a compact conformation wherein the C═O and N—H groups are not available to interact with water molecules, which results in hydrophobicity at temperatures above the LCST. These two states (i.e., when the temperature is less than the LCST and when the temperature is greater than the LCST) are illustrated in FIG. 2. This interaction is not dependent on the isopropyl chain, and thus should apply to other acrylamide polymers as well.

The active, switchable stimulus-responsive polymer may be arranged as a layer grafted onto a layer comprising a base polymer matrix. In embodiments, the layer comprising a base polymer matrix may have a fixed surface free energy. For example, in embodiments, the layer comprising a base polymer matrix may have a fixed surface free energy of from about 3 to about 25 dynes/cm, such as from about 10 to about 23 dynes/cm, or from about 15 to about 20 dynes/cm. In embodiments, the base polymer matrix may have a water contact angle of greater than about 80°, or greater than about 100°, such as from about 90 to about 135°.

The base polymer matrix may be any suitable material, such as those described in, for example, U.S. Patent Application Publication Nos. 2011/0244247, 2011/0104499, 2012/0049121, 2010/0330305, and 2011/0244202, the disclosures of which are incorporated by reference herein in their entireties.

For example, suitable materials for a base polymer matrix include low surface energy materials such as TEFLON™-like materials including fluorinated ethylene propylene copolymer (FEP), polytetrafluoroethylene (PTFE), polyfluoroalkoxy polytetrafluoroethylene (PFA TEFLON™), and other TEFLON™-like materials; silicone materials, such as fluorosilicones, and silicone rubbers, such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC™ 735 black RTV and SILASTIC™ 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include the siloxanes (such as polydimethylsiloxanes); fluorosilicones (including partially fluorinated fluorosilicones and fully fluorinated fluorosilicones) such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC™ 590 LSR, SILASTIC™ 591 LSR, SILASTIC™ 595 LSR, SILASTIC™ 596 LSR, and SILASTIC™ 598 LSR from Dow Corning.

Suitable materials for a base polymer matrix may also include fluoroelastomers. Fluoroelastomers are from the class of 1) copolymers of two of vinylidenefluoride, hexafluoropropylene, and tetrafluoroethylene; 2) terpolymers of vinylidenefluoride, hexafluoropropylene, and tetrafluoroethylene; and 3) tetrapolymers of vinylidenefluoride, hexafluoropropylene, tetrafluoroethylene, and cure site monomer. These fluoroelastomers are known commercially under various designations such as VITON A™, VITON B™, VITON E™, VITON E 60C™, VITON E430™, VITON 910™, VITON GH™, VITON GF™, and VITON ETP™. The VITON™ designation is a Trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170™, FLUOREL 2174™, FLUOREL 2176™, FLUOREL 2177™ and FLUOREL LVS 76™, FLUOREL™ being a registered trademark of 3M Company. Additional commercially available materials include AFLAS™, a poly(propylene-tetrafluoroethylene), and FLUOREL II™ (LII900), a poly(propylene-tetrafluoroethylenevinylidenefluoride), both also available from 3M Company, as well as the Tecnoflons identified as FOR-60KIR™, FOR-LHF™, NM. FOR-THF™, FOR-TFS™, TH™, NH™, P757™, TNS™, T439™, PL958™, BR9151™ and TN505™ available from Ausimont. The cure site monomer can be those available from E.I. DuPont de Nemours, Inc., such as 4-bromoperfluorobutene-1,1,1-dihydro-4-bromoperfluorobutene-1,3-bromoperfluoropropene-1,1,1-dihydro-3-bromoperfluoropropene-1, or any other suitable, known, commercially available cure site monomer.

Characterization of the wetting properties of an intermediate transfer member containing the polymer composition may be carried out by measuring the water droplet contact angle at a given temperature. In embodiments, the surface free energy above and below the critical activation temperature—and, as such, the wetting performance—may be tuned by controlling the degree of polymerization of the composition and the number of grafted polymer chains. In embodiments, below the critical activation temperature, an intermediate transfer member according to the instant disclosure may have a water contact angle of from about 80° to about 150°, such as from about 90° to about 140°, or from about 100° to about 130°. In embodiments, at or above the critical activation temperature, an intermediate transfer member may have a water contact angle of from about 10° to about 70°, such as from about 15° to about 50°, or from about 20° to about 45°.

Ink Materials

Any ink suitable for use in an indirect printing method may be used. Exemplary ink compositions include, for example, phase change inks, gel based inks, curable inks, aqueous inks, and solvent inks. The term "ink composition" refers, for example, to all colors of a particular ink composition including, for example, usable color sets of an ink composition. For example, an ink composition may refer to a usable color set of phase change ink that includes cyan, magenta, yellow, and black inks. Therefore, as defined herein, cyan phase change ink and magenta phase change ink are different ink colors of the same ink composition.

The term "phase change ink," also referred to as "solid ink," refers, for example, to inks that remain in a solid phase at ambient temperature and that melt to a liquid phase when heated above a threshold temperature, referred to in some instances as a melt temperature. The ambient temperature is the temperature of the air surrounding the imaging device; however, the ambient temperature may be at room temperature (about 20° C. to about 25° C.) when the imaging device is positioned in an enclosed or otherwise defined space. Melt temperatures for phase change ink may be, for example, from about 70° C. to about 140° C., such as from about 80° C. to about 100° C., or from about 110° C. to about 130° C. When phase change ink cools below the melt temperature, the ink returns to the solid phase.

As used herein, the terms "gel ink" and "gel based ink" refer, for example, to inks that remain in a gelatinous state at the ambient temperature and that may be heated or otherwise altered to have a different viscosity suitable for ejection by a printhead. Gel ink in the gelatinous state may have a viscosity, for example, between from about $10^5$ and $10^7$ centipoise (cP); however, the viscosity of gel ink may be reduced to a liquid-like viscosity by heating the ink above a threshold temperature, referred to as a gelation temperature. The gelation temperature may be, for example from about 30° C. to about 50° C., such as from about 31° C. to about 38° C., or from about 41° C. to about 48° C. The viscosity of the gel ink increases when the ink cools below the gelation temperature.

Some ink compositions, referred to herein as curable inks, may be cured by the imaging device. As used herein, the process of "curing" ink refers to curable compounds in an ink undergoing an increase in molecular weight in response to being exposed to radiation. Exemplary processes for increasing the molecular weight of a curable compound include, for example, crosslinking and chain lengthening. Cured ink is suitable for document distribution, is resistant to smudging, and may be handled by a user. Radiation suitable to cure ink may encompass the full frequency (or wavelength) spectrum including, for example, microwaves, infrared, visible, ultraviolet, and x-rays. For instance, ultraviolet-curable gel ink, referred to herein as UV gel ink, becomes cured after being exposed to ultraviolet radiation. As used herein, the term "ultraviolet" radiation encompasses radiation having a wavelength of from about 50 nm to about 500 nm.

In embodiments, an ink suitable for use in the above-described two-step printing process may have surface tension, viscosity, and particle size suitable for use in a piezoelectric inkjet printhead. In embodiments, the surface tension of the jettable ink may be from about 15 to about 50 dynes/cm, such as from about 18 to about 45 dynes/cm, or from about 20 to about 40 dynes/cm, or from about 22 to about 32 dynes/cm. The viscosity of the jettable inks may be, for example, from about 1 to about 30 centipoise (cps) at 30° C., such as from about 3 to about 20 cps, or from about 5 to about 18 cps, or from about 6 to about 17 cps. In embodiments, the particle size of the jettable inks may be less than about 600 nm, such as less than about 300 nm, or less than about 150 nm.

Method of Making an Intermediate Transfer Member

A polymer composition according to the instant disclosure may be prepared according to any suitable method. For example, in embodiments, a polymer composition according to the instant disclosure may be produced by providing a first polymer layer comprising a base polymer matrix, and grafting a second polymer layer comprising a stimulus-responsive polymer onto the first polymer layer, where the surface free energy of the polymer composition may be reversibly adjusted from a first surface free energy state to as second surface free energy state when heated to a predetermined critical activation temperature.

The first polymer layer comprising a base polymer matrix may be prepared according to any suitable method, such as those described in, for example, U.S. Patent Application Publication Nos. 2011/0244247, 2011/0104499, 2012/0049121, 2010/0330305, and 2011/0244202. The components of the first polymer layer may undergo blanket coating to produce the first polymer layer. In embodiments, the first polymer layer may be cast or surface coated.

Casting involves pouring the polymer mixture into a mold, and then curing. In embodiments, the polymer mixture may be cured over a time period of from about 0.5 hours to about 6 hours, such as from about 1 hour to about 5 hours, or from about 2 hours to about 4 hours. The polymer mixture may be cured at an appropriate temperature, such as from about 90° C. to about 200° C., or from about 100° C. to about 150° C., or from about 110° C. to about 130° C.

In embodiments, the first polymer layer may be surface coated. In embodiments, surface coating may be carried out on a suitable substrate. Any suitable substrate may be used. In embodiments, the substrate may include, for example, metals, rubbers, and fabrics. Metals include steel, aluminum, nickel, and their alloys, and like metals and alloys of like metals. Examples of suitable rubbers include ethylene propylene dienes, fluoroelastomers, n-butyl rubbers, silicone rubbers and other elastomers and the like. A fabric material, as used herein, refers to a textile structure comprised of mechanically interlocked fibers or filaments, which may be woven or nonwoven. Fabrics are materials made from fibers or threads and woven, knitted, or pressed into a cloth or felt type structures. Woven, as used herein, refers to closely oriented by warp and filler strands at right angles to each other. Nonwoven, as used herein, refers to randomly integrated fibers or filaments. Examples of fabrics include woven or nonwoven cotton fabric, graphite fabric, fiberglass, woven or nonwoven polyimide (for example, KEVLAR™, available from DuPont), woven or nonwoven polyamide, such as nylon or polyphenylene isophthalamide (for example, NOMEX™, of E. I. DuPont of Wilmington, Del.), polyester, aramids, polycarbonate, polyacryl, polystyrene, polyethylene, polypropylene, cellulose, polysulfone, polyxylene, polyacetal, and the like, and mixtures thereof. The substrate may have a thickness of from about 1 to about 70 mm, such as from about 10 to about 65 mm, or from about 30 to about 60 mm.

During surface coating, the first polymer layer may be deposited on the substrate by any suitable process. Exemplary methods for depositing the first polymer layer on the substrate include draw-down coating, spray coating, spin coating, flow coating, dipping, spraying such as by multiple spray applications of very fine thin films, casting, web-coating, roll-coating, extrusion molding, laminating, or the like. The thickness of the first polymer layer may be from about 5 to about 500 microns thick, such as from about 10 to about 400 microns, or from about 20 to about 300 microns. The surface coating may be cured for a time period of from about 0.5 hours to about 6 hours, such as from about 1 hour to about 5 hours, or from about 2 hours to about 4 hours, at an appropriate temperature, such as from about 90° C. to about 200° C., or from about 100° C. to about 150° C., or from about 110° C. to about 130° C.

The resulting first polymer layer may have a fixed surface free energy of from about 3 to about 25 dynes/cm, such as from about 10 to about 23 dynes/cm, or from about 15 to about 20 dynes/cm. In embodiments, the base polymer matrix may have a water contact angle of greater than about 80°, or greater than about 100°, such as from about 90 to about 135°.

In embodiments, the second polymer layer comprising a stimulus-responsive polymer may be grafted onto the first polymer layer. In embodiments, a surface of the first polymer layer may be activated to promote grafting of the second polymer layer on the first polymer layer.

In embodiments, the activating process may include subjecting the first polymer layer to a plasma treatment. Any suitable plasma generator can be used for the plasma treatment. For example, the Harrick Plasma Cleaner/Sterilizer (model PDC-32G) may be used. The tabletop plasma and plasma generator such as "Plasma Spot" for production form GaLa Instrumente GmbH can also be used. The plasma generator may be, for example, from about 100 W to about 50 kW at a frequency of from about 24 kHz to about 13.56 MHz. In embodiments, the plasma generator is Radio Frequency emission type plasma. In embodiments, the ion energy may be less than about 12 eV, such as less than about 11 eV, or less than about 10 eV. In embodiments, the first polymer layer may be subjected to plasma treatment for from about 1 minute to about 30 minutes, such as from about 5 minutes to about 20 minutes, or from about 10 minutes to about 15 minutes. Treatment with a plasma may create reactive hydroxyl (—OH) groups on the surface of the first polymer layer suitable for surface grafting.

In embodiments, the thermally responsive layer can be grafted directly onto the first polymer layer having reactive hydroxyl groups. The hydroxyl-terminated surface may be reacted with triethoxysilane terminated poly(N-isopropylacrylamide) at a reflux temperature in a suitable solvent to provide the final thermally responsive grafted layer onto the surface of the first polymer layer. Suitable solvents include toluene, methylene chloride, tetrahydrofuran, monochlorobenzene, N-methyl-2-pyrrolidone (NMP), N,N-dimethylformamide, N,N-dimethylacetamide, methyl ethyl ketone, methyl isobutyl ketone, mixtures thereof, and the like.

In embodiments, the first polymer layer having reactive hydroxyl groups on its surface may be subjected to further surface treatment. For example, in embodiments, the first polymer layer having reactive hydroxyl groups on its surface may be subjected to further surface treatment to create an amino-terminated surface. In embodiments, the first polymer layer may be reacted with a suitable amination agent, such as, for example, aminopropyl trimethoxysilane (APTMS), N-(3-trimethoxysilylpropyl)ethylenediamine, or aminopropyl-triethoxysilane (APTES). In embodiments, the first polymer layer may be refluxed with the amination agent in a suitable solvent, such as toluene, methylene chloride, tetrahydrofuran, monochlorobenzene, N-methyl-2-pyrrolidone (NMP), N,N-dimethylformamide, N,N-dimethylacetamide, methyl ethyl ketone, methyl isobutyl ketone, mixtures thereof, and the like, to produce an amino terminated surface on the first polymer layer.

In embodiments, the stimulus-responsive polymer may be grated onto the amino-terminated surface by linking it to the surface through the active —$NH_2$ groups, where the polymer chain may be grown on the top of the surface. A general procedure for the grafting process may be based on atom-transfer polymerization process as described in, for example, T. Sun et al., Reversible Switching Between Superhydrophilicity and Superhydrophobicity, 43 *Angew. Chem. Int. Ed.* 357, 357-60 (2004) (using silicon wafer surfaces), the entire disclosure of which is incorporated herein by reference in its entirety. In embodiments, for example, the first polymer layer may be placed in a suitable solvent with a base. The base may include: an inorganic base such as sodium carbonate ($Na_2CO_3$), potassium carbonate ($K_2CO_3$), cesium carbonate (Cs.sub.2CO.sub.3), or barium hydroxide (Ba(OH).sub.2); and an organic base such as triethylamine ($N(C_2H_5)_3$), diisopropylamine ($NH(CH_3)$.sub$_2$CH)$_2$), diethylamine ($NH(C_2H_5)_2$), dimethylamine ($NH(CH_3)_2$), trimethylamine ($N(CH_3)_3$), 1,8-diazabicyclo[5.4.0]-7-undecene (DBU), N,N-dimethyl-4-aminopyridine (DMAP), or pyridine. A polymerization initiator may be added, yielding a surface with a grafted polymerization initiator. Polymerization initiators include, for example, bromoisobutyryl bromide, 2-bromo-2-methyl propionic acid, 2-chloro-2-methyl-priopionic acid, a chloro phenyl carboxylic acid, a bromomethyl phenyl carboxylic acid, a maleimide derivative of 2-bromo-2-methyl propionic acid, and mixtures and derivates thereof. The stimulus-responsive polymer may be added, yielding a top stimulus-responsive polymer terminated (such as a top PNIPA terminated) surface. The thickness of the surface may be, for example, from about 5 to about 200 nm, such as from about 7 to about 150 nm, or from about 10 to about 100 nm.

In other embodiments, the stimulus-responsive polymer may be grafted onto the amino-terminated surface by linking it to the surface through the active —$NH_2$ groups directly as a polymer. In this case, a poly(N-alky acrylamide) polymer terminated with a suitable functional group may be used. Suitable terminal groups on the reactive polymer are capable of forming a covalent bond by reacting with the amino surface. Such functional groups include —COOH, OH, and N-hydroxysuccinimide ester. Suitable polymer compounds are commercially available. For example, poly(N-isopropylacrylamide), carboxylic acid terminated average $M_n$ 5,000 and $M_n$ 7,000, as well as poly(N-isopropylacrylamide), N-hydroxysuccinimide (NHS) ester terminated average $M_n$ 2,000 are commercially available from Sigma-Aldrich (Delaware).

EXAMPLES

The following examples are being submitted to illustrate embodiments of the present disclosure. These examples are intended to be illustrative only and are not intended to limit the scope of the present disclosure. Parts and percentages are by weight unless otherwise indicated. As used herein, "room temperature" refers to a temperature of from about 20° C. to about 30° C.

Example 1

Preparation of an Intermediate Transfer Member

An intermediate transfer member may be prepared as follows. An intermediate transfer member having low surface free energy may be prepared by mixing PART A of a commercially available crosslinkable PDMS two-component system (such as manufactured by Dow Corning Corporation) with a PART B PDMS curing agent in a ratio of 10 to 1, as compared to the amount of PART A. The mixture is stirred and then degassed for 20 minutes prior to blanket coating preparation. The PDMS mixture may be either cast or surface coated.

For example, in embodiments, the PDMS mixture may be cast by pouring the polymer mixture into a mold, followed by curing for 2-4 hours at 120° C. Alternatively, the polymer mixture may be surface coated on a suitable substrate by any appropriate method, such as draw-down coating, spray coating, spin coating, or flow coating, yielding a surface coating that is from about 20 to about 300 microns thick, which is cured for 2-4 hours at 120° C. The casting or surface coating yields a blanket having low surface free energy (i.e., where the surface free energy is from about 3 to about 25 dynes/cm).

The low-SFE blanket is exposed to plasma treatment using a Harrick Plasma Cleaner/Sterilizer (model PDC-32G) for 10 minutes, creating reactive hydroxyl (—OH) groups on the surface of the blanket suitable for surface grafting. Contact angle (CA) measurements, as shown in Table 2, verified the creation of hydroxyl groups, indicated by a switch from a hydrophobic surface to a hydrophilic surface upon plasma oxidation of the PDMS for 10 minutes.

TABLE 2

Contact Angle Measurements

| | Water CA | Literature Water CA*1 |
|---|---|---|
| Non treated PDMS | ~109.4° ± 0.4° | 110.2 ± 2.3° |
| Plasma Treated PDMS | <30° | 30.1° ± 1.9° |

*1: Anal. Chem., 2006, 78, 21, 7446.

The hydroxyl-terminated surface is heated at 130° C. to provide a reflux of toluene that contains 5% aminopropyl trimethoxysilane for 3-8 hours to obtain an amino (—$NH_2$) terminated surface.

An SFE-thermally switchable material like PNIPA may be grafted onto the amino terminated surface by linking it to the surface through the active —$NH_2$ groups, and the polymer chain is consequently grown on the top of the surface. To do this, the amino-terminated surface is placed in dichloromethane containing a 5-10% of pyridine. A polymerization initiator (such as bromoisobutyryl bromide) is added at 0° C. and the mixture is kept at room temperature for 12 hours, yielding a surface with a grafted polymerization initiator. After cleaning with solvent, the surface is immersed in a degassed solution of N-isopropylacrylamide in a mixture of water/methanol containing CuBr and pentamethyl diethylene triamine for 10 hours. This yields a top PNIPA terminated surface with a thickness of from about 10 nm to about 100 nm.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A polymer composition comprising:

a first polymer layer comprising a base polymer matrix; and a second polymer layer grafted onto the first polymer layer; wherein the second polymer layer comprises a stimulus-responsive polymer; and the surface free energy of the stimulus-responsive polymer is reversibly adjustable from a first surface free energy state to a second surface free energy state when heated to a predetermined critical activation temperature.

2. The polymer composition according to claim 1, wherein the surface free energy of the first surface free energy state is from about 26 to about 70 dynes/cm, and the surface free energy of the second surface free energy state is from about 3 to about 25 dynes/cm, and the difference between the surface free energy of the first surface free energy state and the second surface free energy state is greater than about 1 dyne/cm.

3. The polymer composition according to claim 1, wherein the surface free energy of the base polymer matrix is from about 3 to about 25 dynes/cm.

4. The polymer composition according to claim 1, wherein the stimulus-responsive polymer comprises a monomer unit selected from the group consisting of N-isopropylacrylamide, N-ethylacrylamide, N-n-propylacrylamide, N-ethyl,N-methylacrylamide, N,N-diethylacrylamide, N-isopropyl,N-methylacrylamide, N-cyclopropylacrylamide, N-acryloylpyrrolidine, and N-acryloylpiperidine and mixtures thereof.

5. The polymer composition according to claim 1, wherein the stimulus-responsive polymer is selected from the group consisting of poly-(N-isopropylacrylamide), poly-(N-ethylacrylamide), poly-(N-n-propylacrylamide), poly(N-ethyl, N-methylacrylamide), poly(N,N-diethylacrylamide), poly (N-isopropyl,N-methylacrylamide), poly(N-cyclopropylacrylamide), poly(N-acryloylpyrrolidine) and poly(N-acryloylpiperidine) and mixtures thereof.

6. The polymer composition according to claim 1, wherein the predetermined critical activation temperature is from about 10° C. to about 120° C.

7. The polymer composition according to claim 1, wherein the base polymer matrix is selected from the group consisting of silicones, fluoropolymers, fluorinated polyimide, and networked siloxyfluorocarbons.

8. The polymer composition according to claim 1, wherein the second polymer layer has a thickness of from about 5 nm to about 200 nm.

9. An intermediate transfer member comprising the polymer composition according to claim 1.

10. A printing apparatus comprising:

an intermediate transfer member comprising the polymer composition according to claim 1.

11. A method of preparing a polymer composition, the method comprising:

providing a first polymer layer comprising a base polymer matrix; and grafting a second polymer layer comprising a stimulus-responsive polymer onto the first polymer layer;

wherein the surface free energy of the stimulus-responsive polymer may be reversibly adjusted from a first surface free energy state to a second free energy state when heated to a predetermined critical activation temperature.

12. The method of preparing a polymer composition according to claim 11, further comprising:

surface treating the first polymer layer to yield reactive hydroxyl groups on the surface of the first polymer layer; and surface treating the first polymer layer having reactive hydroxyl groups on its surface to create an amino-terminated surface;

wherein the first polymer layer is surface treated before the second polymer layer comprising a stimulus-responsive polymer is grafted onto the first polymer layer.

13. A method of printing an image to a substrate, the method comprising:

applying an inkjet ink onto an intermediate transfer member using an inkjet printhead;

spreading the ink onto the intermediate transfer member;

inducing a property change of the ink; and transferring the ink to a substrate;

wherein the intermediate transfer member comprises a first polymer layer comprising a base polymer matrix and a second polymer layer comprising a stimulus-responsive polymer, wherein the second polymer layer is grafted onto the first polymer layer; and the surface free energy of the stimulus-responsive polymer is reversibly adjustable from a first surface free energy state to a second surface free energy state when heated to a predetermined critical activation temperature.

14. The method according to claim 13, wherein the surface free energy of the first surface free energy state is from about 26 to about 70 dynes/cm, and the surface free energy of the second surface free energy state is from about 3 to about 25 dynes/cm, and the difference between the surface free energy of the first surface free energy state and the second surface free energy state is greater than about 1 dyne/cm.

15. The method according to claim 13, further comprising heating the intermediate transfer member to a temperature at or above the predetermined critical activation temperature after inducing a property change of the ink.

16. The method according to claim 13, wherein the surface free energy of the base polymer matrix is from about 3 to about 25 dynes/cm.

17. The method according to claim 13, wherein the stimulus-responsive polymer comprises a monomer unit selected from the group consisting of N-isopropylacrylamide N-ethylacrylamide, N-n-propylacrylamide, N-ethyl,N-methylacrylamide, N,N-diethylacrylamide, N-isopropyl,N-methylacrylamide, N-cyclopropylacrylamide, N-acryloylpyrrolidine, N-acryloylpiperidine, and mixtures thereof.

18. The method according to claim 13, wherein the stimulus-responsive polymer is selected from the group consisting of poly-N-isopropylacrylamide, poly-(N-ethylacrylamide), poly-(N-n-propylacrylamide), Poly(N-ethyl,N-methylacrylamide), Poly(N,N-diethylacrylamide), Poly(N-isopropyl,N-methylacrylamide), Poly(N-cyclopropylacrylamide), Poly (N-acryloylpyrrolidine) and Poly(N-acryloylpiperidine) and mixtures thereof.

19. The method according to claim 13, wherein the predetermined critical activation temperature is from about 10° C. to about 120° C.

20. The method according to claim 13, wherein the base polymer matrix is selected from the group consisting of silicones, fluoropolymers, fluorinated polyimide, and networked siloxyfluorocarbons.

* * * * *